US008783196B2

(12) United States Patent
Zhao et al.

(10) Patent No.: US 8,783,196 B2
(45) Date of Patent: Jul. 22, 2014

(54) AC PLASMA EJECTION GUN, THE METHOD FOR SUPPLYING POWER TO IT AND PULVERIZED COAL BURNER

(75) Inventors: Hujun Zhao, Beijing (CN); Bin Li, Beijing (CN); Di Jiang, Beijing (CN); Guangrong Chen, Beijing (CN); Zhaojun Zhang, Beijing (CN); Dezhe Nan, Beijing (CN)

(73) Assignee: Beijing Gungyao Electricity Equipment Co. Ltd., Beijing (CN)

( * ) Notice: Subject to any disclaimer, the term of this patent is extended or adjusted under 35 U.S.C. 154(b) by 839 days.

(21) Appl. No.: 12/824,953

(22) Filed: Jun. 28, 2010

(65) Prior Publication Data

US 2010/0300335 A1 Dec. 2, 2010

Related U.S. Application Data

(63) Continuation of application No. PCT/CN2008/073545, filed on Dec. 17, 2008.

(30) Foreign Application Priority Data

| | | |
|---|---|---|
| Dec. 27, 2007 | (CN) | 2007 1 0304411 |
| Jul. 2, 2008 | (CN) | 2008 1 0116024 |
| Jul. 2, 2008 | (CN) | 2008 2 0108986 U |
| Jul. 24, 2008 | (CN) | 2008 1 0117133 |
| Aug. 1, 2008 | (CN) | 2008 2 0109603 U |

(51) Int. Cl.

| | |
|---|---|
| ***F23D 1/00*** | (2006.01) |
| ***F23C 99/00*** | (2006.01) |
| ***H05H 1/42*** | (2006.01) |
| ***H05H 1/36*** | (2006.01) |
| *H05H 1/34* | (2006.01) |

(52) U.S. Cl.

CPC ..... *H05H 1/42* (2013.01); *F23C 99/001* (2013.01); *H05H 1/36* (2013.01); *H05H 2001/3431* (2013.01); *F23D 1/00* (2013.01); *F23C 2900/99005* (2013.01)

USPC ..... 110/263; 219/121.54; 219/121.57

(58) Field of Classification Search

USPC ..... 110/263; 219/121 PN, 121 PM, 121 P, 219/76.16, 74, 75, 121 PR, 121 PP, 121.54, 219/121.57

See application file for complete search history.

(56) References Cited

U.S. PATENT DOCUMENTS

| | | | | |
|---|---|---|---|---|
| 3,024,350 A | | 3/1962 | Skinner et al. | |
| 4,520,739 A | * | 6/1985 | McCartney et al. | 110/263 |

(Continued)

FOREIGN PATENT DOCUMENTS

| | | | |
|---|---|---|---|
| CN | 2348962 | | 11/1999 |
| CN | 1786579 | * | 6/2006 |

(Continued)

OTHER PUBLICATIONS

Chen, Yili et al., "Experimental Study on Direct Igniting Pulverized Coal by High Energy Arc, Electric Power," Jun. 1981, No. 5, pp. 54-56.

(Continued)

*Primary Examiner* — Kenneth Rinehart
*Assistant Examiner* — Bao D Nguyen
(74) *Attorney, Agent, or Firm* — Hanley, Flight & Zimmerman, LLC

(57) ABSTRACT

An AC plasma ejection gun, a method for supplying power to the gun, and a pulverized coal burner are provided. The ejection gun comprising a front electrode and a rear electrode. There is a gap between the electric rear electrode and said front electrode. The ejection gun can work with small current and large power, so that the life of the plasma ejection gun is prolonged.

20 Claims, 9 Drawing Sheets

(56) References Cited

U.S. PATENT DOCUMENTS

| | | | | | |
|---|---|---|---|---|---|
| 4,668,853 | A | * | 5/1987 | Fey et al. | 219/121.49 |
| 5,045,667 | A | * | 9/1991 | Iceland et al. | 219/121.54 |
| 5,937,770 | A | * | 8/1999 | Kobayashi et al. | 110/263 |
| 7,281,478 | B2 | * | 10/2007 | Wang et al. | 110/347 |

FOREIGN PATENT DOCUMENTS

| | | | |
|---|---|---|---|
| CN | 200961855 | * | 10/2007 |
| CN | 200980199 | | 11/2007 |
| CN | 101216183 | * | 7/2008 |
| CN | 101309546 | | 11/2008 |

OTHER PUBLICATIONS

Sun, Chaofan et al., "Technical Principle and Application Research of Plasma Ignition Burner," Guangdong Electric Power, Jan. 2005, vol. 18, No. 1, pp. 19-22.

International Searching Authority, "International Search Report," issued in connection with international application serial No. PCT/CN2008/073545, mailed Mar. 26, 2009, 10 pages.

* cited by examiner

B–B
C–C
D–D
E–E
F–F
2
3
4
21
22
23
24
25
25'
26
31
32
41
42
221

G–G

J–J

H–H

I–I

AC PLASMA EJECTION GUN, THE METHOD FOR SUPPLYING POWER TO IT AND PULVERIZED COAL BURNER

RELATED APPLICATIONS

This patent arises from a continuation of PCT Application No. PCT/CN2008/073545, filed on Dec. 17, 2008, which claims priority to Chinese Patent Application No. 200710304411.X, filed on Dec. 27, 2007; Chinese Patent Application No. 200810116024.8, filed on Jul. 2, 2008; Chinese Patent Application No. 200820108986.4, filed on Jul. 2, 2008; Chinese Patent Application No. 200810117133.1, filed on Jul. 24, 2008; and Chinese Patent Application No. 200820109603.5, filed on Aug. 1, 2008, which are hereby incorporated herein by reference in their entireties.

TECHNICAL FIELD

The present invention relates to an AC plasma ejection gun, a pulverized coal burner comprising the AC plasma ejection gun, and a method for supplying power to AC plasma ejection gun to generate arc uninterruptedly.

BACKGROUND OF THE INVENTION

A plasma generator could provide a kind of efficient and clean heat source, i.e. plasma flow, for use in the field of industry, such as ignition of a burner in a power station, cutting, jointing, spraying, metallurgy, chemical industry, and waste treatment, and the field of science, such as material and aerospace. The heated plasma has very high temperature and high enthalpy, and comprises a great number of electric particles (electrons and ions), which is different from the high-temperature gas created by chemistry burning. A plurality of processes that could not be realized in the past can be realized well under the condition of plasma.

After 2000 years, direct current (DC) plasma ignition technology has been successfully used in coal-powder burners. The so called DC plasma ignition technology means that the DC current starts arc under certain medium pressure, and obtains directionally flowing air plasma with steady power through the control of a strong magnetic field. The plasma will create a local high temperature fire core with great temperature gradient in the ignition burner, wherein the temperature is higher than 4000K. The coal powder particles release volatile material and re-creates volatile material, being broken and pulverized, and then burn quickly when pass through the plasma "fire core", so as to achieve the objection of ignition and accelerating the burning of coal-powder. The technology has been well-known for the ignition without oil.

However, the DC ignition technology is limited by its technical weakness and has a plurality of problems. At present, hot cathode DC plasma ignition technology with high current and hot electrons ejection is mainly used. In the utilization of this technology, the current increases along with the power increasing. So the power of DC plasma ignition will be hardly more than 150 kW. And the life of cathode is less than 50 Hours. The cathode has to be made from precious metal and its price and running cost are both very high. The cost of rectifier power system for DC plasma ignition technology is high and its volume is huge.

Therefore, the present invention is intended to overcome the above limitations.

SUMMARY OF THE INVENTION

The object of the present invention is to provide an AC plasma ejection gun for producing plasma with alternating current.

Another object of the present invention is to provide a pulverized coal burner comprising the above AC plasma ejection gun.

Still a further object of the present invention is to provide a method for supplying power to AC plasma ejection gun to generate arc uninterruptedly.

For the above objections, the present invention provides an AC plasma ejection gun, including:

a power supply device, said power supply device has live wire and null wire;

an electric front electrode, inside of which a front chamber is set, a nozzle connected with the front chamber is set at the outlet of the front electrode, and an air pipe connected with the front chamber is set at the inlet of the front electrode connected with the null line;

an electric rear electrode, which is set at the inlet of the front electrode, and there is a gap between the rear electrode and said front electrode; wherein the rear electrode is connected with the live wire, a spinning air inlet ring is set outside of the gap between the front electrode and the rear electrode, and compressed air from said inlet pipe is injected into said front chamber through the spinning air inlet ring; and Wherein, an arc between the front electrode and the rear electrode discharges and the compressed air in the gap between the front electrode and the rear electrode is ionized to produce plasma, and the produced plasma is ejected from the nozzle via said the front chamber.

The present invention still provides a pulverized coal burner including the above AC plasma ejection gun, wherein the burner comprising: a multi-stage ignition combustion chamber, at the axial side wall of which a plurality of plug jacks are set; and an AC plasma ejection gun is set in each plug jack, for igniting the pulverized coal passed through the multi-stage ignition combustion chamber.

The present invention still provides a pulverized coal burner including the above AC plasma ejection gun, the burner comprising: a speed-lowering ignition combustion chamber, at the axial side wall of which at least one plug jack is set; an AC plasma ejection gun is set in each plug jack, for igniting the pulverized coal passed through the speed-lowering ignition combustion chamber.

The present invention still provides a method for supplying power to AC plasma ejection gun to generate arc uninterruptedly, the method comprising: increasing the output voltage and frequency of AC power supply for arc starting; loading a main AC power supply and the output of the AC power supply for starting arc of which the voltage and frequency have been increased on the AC plasma ejection gun. The AC power supply for starting arc of which the output voltage and frequency have been increased will continue to provide power to the AC plasma ejection gun so as to create arc, when the main AC power source is passing zero point.

CHARACTERISTICS AND ADVANTAGES OF THE PRESENT INVENTION

1. The spinning air inlet ring of the plasma ejection gun of the present invention could make the compressed air spin into the gun, thus elongate the arc, and obtain input with small current and great power to prolong the life of the plasma ejection gun. In addition, with the self arc stabilization function of spinning air, the AC plasma ejection gun does not need an arc stabilization coil.

2. The ablation of the electrode resulted from high temperature is avoided and the life of the plasma ejection gun is prolonged by spinning the arc root, elongating the length of the arc and incorporating the cooling water system.

3. Because the speed-lowering pulverized coal burner of the present invention comprises a gradually expanding part at the front end of the pipe wall and a speed-lowering pipe for performing speed-lowering process for two times, the plasma torch makes the pulverized coal burning area to form a favorable condition with higher density, higher temperature, lower speed, less air and easier to fire. In addition, the pulverized coal concentration and air flow speed are in a good condition for ignition to complete a continuous and stable ignition and burning process by using the speed-lowering ignition combustion chamber, a mixing combustion chamber and a combustion chamber with extra oxygen supplement.

4. Compared with DC plasma ignition, the pulverized coal burner using AC plasma ejection gun ignition according to the present invention has the advantage of lower cost, shorter investment cycle, simpler system, and it is easier to handle, needs less maintenance, easier to control, runs more stably, has more stable fire, lighter flame and has better adaptability for the pulverized coal and first air speed, and it is beneficial to the adjustment of heat loading during the burner starting process, has better compatibility with the operating system, and has higher reliability; The system is reliable, and the electrostatic precipitator is not need to be separated while mounting the AC plasma ejection gun, and the electrode board of the electric precipitator will not be contaminated because no oil is used in combustion. Since the environmental requirement is increasing, bag precipitators are widely adopted by the power station at present; the application of the AC plasma ejection ignition is even beneficial to the application of the bag precipitator.

5. The method for supplying power to AC plasma ejection gun to generate arc uninterruptedly avoids the affection of the phenomenon of AC power passing the zero point when using the AC power. It will keep the equipment creating arc uninterruptedly to produce plasma and improve the efficient of generation.

DETAILED DESCRIPTION OF PREFERRED EMBODIMENT

Embodiment 1

Figure 1:
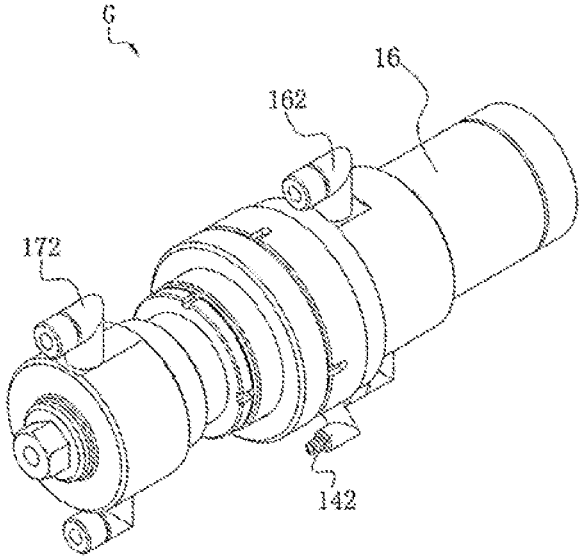
FIG. 1 is a figure illustrates the three dimensional schematic plan of the AC plasma ejection gun of the present invention.
Figure 2:
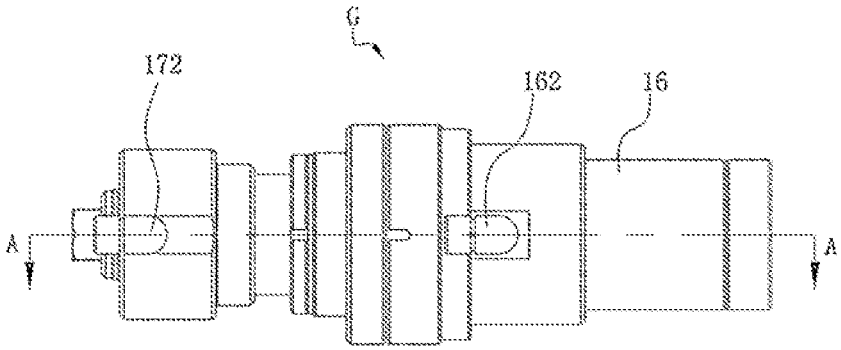
FIG. 2 is a figure illustrates the front view of the AC plasma ejection gun of the present invention.

As shown in the FIGS. 1-4, the present invention provides an AC plasma ejection gun, which could directly use single phase power supply of AC power, such as AC power of 380V, to produce plasma. The ejection gun comprises a power supply device, an electrical front electrode 11 and an electrical rear electrode 12. The power supply device comprises live wire and null wire. A front chamber is set inside of the front electrode 11. A nozzle 111 connected with the front chamber is set at the outlet of the front electrode 11 (that is, the end away from rear electrode 12). An air inlet pipe 142 connected with the front chamber is set at the inlet end of the front electrode 11 and compressed air could be injected into the front chamber via the air inlet pipe 142. The null wire is connected with the front electrode, wherein the front electrode is a hollow cylindrical electrode.

The rear electrode 12 is set at the inlet of the front electrode 11. There is a gap 13 between the rear electrode 12 and the front electrode 11. Preferably, the gap could be between 1 mm and 4 mm. The rear electrode is connected with the live wire. A continuous arc between the front electrode 11 and the rear electrode 12 discharges, and the compressed air is ionized into plasma in the gap between two electrodes and ejected out of the front nozzle 111 via the front chamber.

Figure 4:
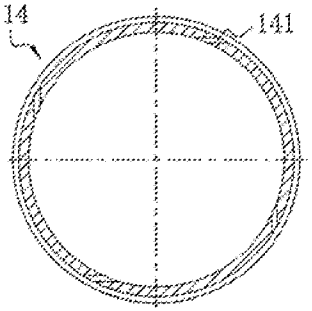
FIG. 4 is a figure illustrates the front sectional view of the spinning inlet air ring used in the AC plasma ejection gun of the present invention.
Figure 4A:
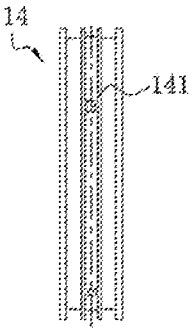
FIG. 4A is a figure illustrates the side view of FIG. 4.

A spinning air inlet ring 14 is set outside of the gap 13 between the front electrode 11 and the rear electrode 12. The compressed air injected from the inlet pipe 142 goes through the spinning air inlet ring 14 and becomes an ultrasonic spinning air flow. When the spinning air goes through the gap 13 between the front electrode 11 and the rear electrode 12, it is ionized by the arc between the front electrode 11 and the rear electrode 12 to form spinning plasma, and enters into the front chamber of the front electrodes 11 and is ejected out from nozzle 111. Concretely, as shown in the FIGS. 4 and 4A, the spinning air inlet ring 14 is circular and a plurality of air inlet jacks 141 are set at the circumferential wall along tangent direction, and every jack is connected with an air inlet pipe 142. Here, four air inlet jacks are set. The compressed air from air inlet pipe 142 of the ejection gun is injected into air inlet jack 141 to become spinning air flow, thereby, to be able to sufficiently elongate the arc length produced by ionizing the spinning air flow. As the arc voltage increases along with the increasing of the arc length, the present invention could work well with lower current to produce same power. Therefore the electrode ablation will be decreased greatly.

A rear chamber, of which the back end (away from the front electrode 11) is closed and the front end is open, is set inside of the rear electrode 12. Therefore, the rear chamber is connected with the front chamber, where the rear electrode 12 is a hollow cylindrical electrode. Wherein, the front, rear electrodes 11, 12 and the spinning air inlet ring 14 are all made of metal.

The voltage between the front and the rear electrodes is varying with time going for using AC power in the present invention, therefore the arc produced by AC plasma ignition technology is easy to die and unstable, so, in preferred embodiment, the power supply device further involves a high frequency arch starting device (not shown in the figures). The rear electrode 13 is connected with the live wire of the power supply through the high frequency arc starting device, which is a high frequency oscillator and mainly comprises a step-up transformer. The high frequency arc starting device can transform the low frequent signal at the input end into signal of high voltage and high frequency, in other words, high frequent electric sparks can be produced to follow and ignite dead arc to keep the arc stable by the high frequency arc starting device. Please find the detailed description of the power supply device in the following embodiment 2.

Figure 3:
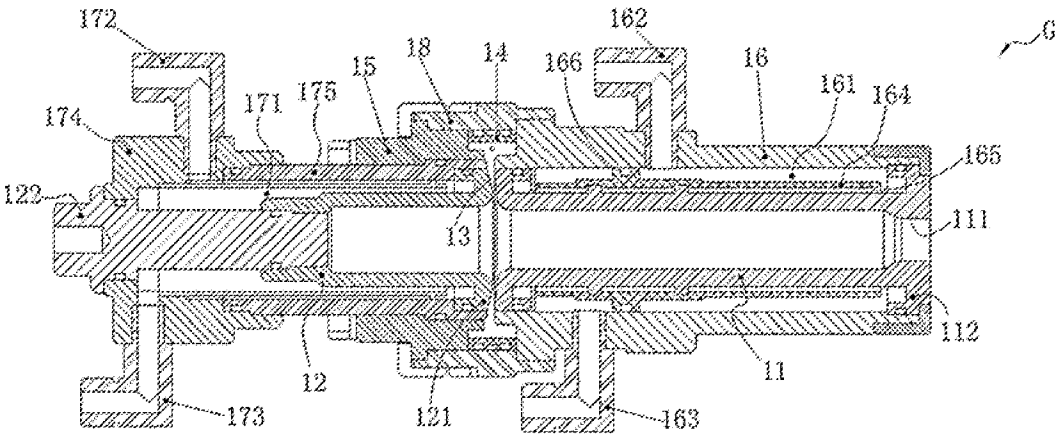
FIG. 3 is a figure illustrates the enlarged sectional view taken along line A-A in FIG. 2.

As shown in the FIG. 3, the gap 13 between said front and rear electrodes 11, 12 is conical to some extent, which means that the inside of the front electrode 11 projects out in relative to the outside of the electrode 11 at the end surface of the front electrode 11, and the inside of the rear electrode 12 projects out in relative to the outside of the rear electrode 12 at the end surface of the rear electrode 12, therefore make the gap at the inside smaller than the gap at the outside; the compress air from the spinning air inlet ring 14 is easy to enter into the smaller inside gap from the larger outside gap. In this way, the air flow is easy to flow there between and the ultrasonic air flow is easier to be ionized by the arc between the front and the rear electrodes 11, 12.

A front water cooling system is set outside of the front electrode 11. To be detailed, the present invention further involves a front sleeve 16 made of metal. The front water cooling system comprises a fluid channel 161 between the front electrode 11 and the sleeve 16, and a water inlet pipe 162 and a water outlet pipe 163. The water inlet pipe 162 and the water outlet pipe 163 are connected with the fluid channel 161 respectively. In this embodiment, shoulders 112 are set at the two ends of the front electrode 11. And the front sleeve 16 is set outside of the front electrode 11 and the two ends of the front sleeve 16 are permanently and hermetically connected with the shoulders 112 at two ends of the front electrode 11, thus to form the fluid channel 161 between the front electrode 11 and the sleeve 16. Mounting holes are set at the upside and downside in the radical direction of the front sleeve 16 respectively. The water inlet pipe 162 and the water outlet pipe 163 are hermetically mounted in the mounting holes at the upside and downside, and connected with the fluid channel 161 respectively. Cool water flows from the water inlet pipe 162 into the fluid channel 161, cools the front electrode 11 and then flows out from the water outlet pipe 163. The circular cooling water will take away the heat energy on the electrode imposed by arc, so the front electrode 11 will be cooled sufficiently, and the possibility of electrode ablation could be decreased.

Figure 5:
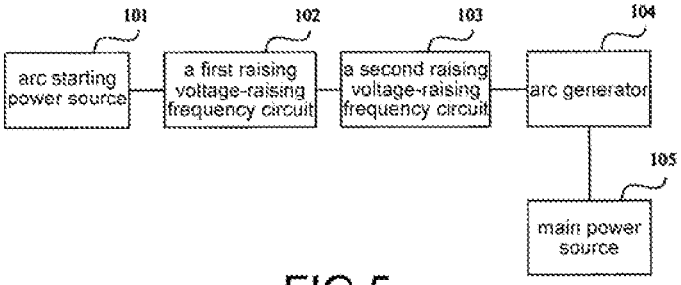
FIG. 5 is a decomposition view of the front electrode and half sleeve of the plasma ejection gun of the present invention.

Still further, a half-sleeve 164 is set inside of the front cooling water system, to prevent the cold water from rapidly flowing out from the outlet pipe 163 before cooling the front electrode 11 sufficiently after it flows from the water inlet pipe 162 into the fluid channel 161. The half-sleeve 164 is located in the front sleeve 16 and covers the outside of the front electrode 11, and there is a gap 165 between the half-sleeve 164 and the front electrode 11. A plurality of circular projections 166 are set at the outside of the half-sleeve 164 in the circumferential direction. The water inlet pipe 162 and the water outlet pipe 163 are set interlaced in the axial direction. The projections 166 are just set at a position between the locations of the water inlet pipe 162 and the water outlet pipe 163 in the axial direction. As shown in the FIG. 3 and FIG. 5, after the cooling water flows into the fluid channel 161 from the water inlet pipe 162, the cooling water is stopped by the projections 166 and flows into the gap 165 from the front end of the front electrode 11 until flows out from the gap 165 of the rear end of the front electrode 11, so as to cool the front electrode 11 sufficiently, and then flows into the fluid channel 161 between the half-sleeve 164 and the front sleeve 16, and then flows out from the water outlet pipe 163. Wherein, the half-sleeve 164 could be separated, so as to easily cover the outside of the front electrode 11.

A rear cooling water system could also be set outside of the rear electrode 12. Wherein, the rear water cooling system has a similar structure with the front water cooling system. A rear sleeve made of metal covers around the outside of the rear electrode 12. The rear water cooling system comprises a fluid channel 171 between the rear electrode 12 and the rear sleeve, and a water inlet 172 and a water outlet 173 are connected with the fluid channel 171 respectively. In this embodiment, the rear sleeve comprises a first rear sleeve 174 and a second rear sleeve 175 which are hermetically connected with each other. The water inlet 172 and the water outlet 173 are mounted at the upside and downside of the first rear sleeve 174. One end of the second rear sleeve 175 is hermetically connected with first rear sleeve 174, and another end of the second rear sleeve 175 is hermetically connected with a projection part 121 of the rear electrode 12, therefore forms the fluid channel 171 between the rear electrode 12 and the rear sleeve. The cooling water flows into the fluid channel 171 from the water inlet 172 and flows out from the water outlet 173 after cooling the rear electrode 12. With the circulation, the cooling water will take away the heat source imposed on the electrode by arc, so that the rear electrode 12 will be cooled sufficiently and the possibility of electrode ablation by high temperature will be decreased.

An insulated ring 15 is set between the front and rear electrode 11, 12, so as to insulate the front and rear electrode 11, 12 from each other. In this embodiment, the insulated ring 15 is set outside of the second rear sleeve 175 and is connected with the spinning air inlet ring 14 to insulate the front and rear electrodes 11, 12 from each other. Concretely, a connecting sleeve 18 made of metal fastens the front sleeve 16, the spinning air inlet ring 14 and the insulated ring together by using a fixer.

In addition, a wiring terminal 122 may be set at the sealed end of the rear electrode 12, and a through hole (not shown in the figure) is set at the wiring terminal 122 in the axially direction for connecting another compressed air. The compressed air enters into the sealed chamber of the rear electrode from the through hole. The compressed air will cool the rear electrode 12 and it also could push the arc ahead.

Embodiment 2

Figure 6:
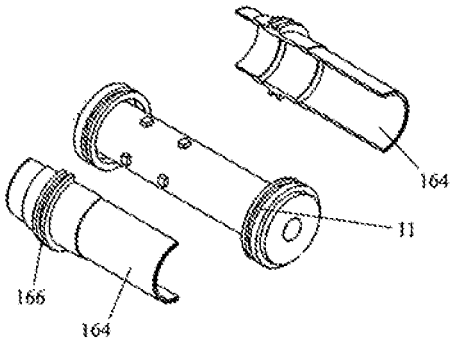
FIG. 6 is a circuit diagram of the AC uninterrupted arc power source of the present invention.

As show in the FIG. 6, the power supply device in this embodiment is an AC uninterrupted arc power supply device comprising an arc starting power source 101, a first raising voltage-raising frequency circuit 102, a second raising voltage-raising frequency circuit 103 and a main supply power source 105. The arc starting power source 101 and the first raising voltage-raising frequency circuit 102 are connected in series, and the first raising voltage-raising frequency circuit 102 and the second raising voltage-raising frequency circuit 103 are connected in three phase's series. The second raising voltage-raising frequency circuit 103 is connected with an arc generator 104 (it is a plasma ejection gun in this embodiment) which is connected with the main supply power source 105. Wherein, the arc generator 104 could be other plasma generator.

The arc starting power source 101 is an AC power, generally is a power source that can supply 220V voltage and has a small current intensity.

The first raising voltage-raising frequency circuit 102 will raise the output voltage of the arc power 101 and raise the frequency of output current of the arc starting power source 101, for example the first raising voltage-raising frequency circuit 101 could transform the municipal electricity has a voltage of 220V and a frequency of 50 Hz to a power source has a voltage of 4 kV and a frequency of 4 kHz.

The second raising voltage-raising frequency circuit 103 could raise the voltage and frequency of electric current outputted from the first raising voltage-raising frequency circuit 102 again. For example, the voltage of the current having a voltage of 4 kV and a frequency of 4 kHz outputted from the first raising voltage-raising frequency circuit 102 could be raised to tens of thousands Volts, and the frequency of its current could be raised to ten thousands Hertz, such as, the voltage is raised to 28 KV, and the frequency is raised to 30 KHz.

The main power source 105 is an AC power source and supply power to the arc generator 104, general it is an industry power having a voltage of 220V and a frequency of 50 Hz. Since the AC power source is used, the main power source will pass zero point twice in each cycle and therefore will lead to the interrupt of the discharging arc produced by the arc generator 104.

The arc generator 104 will receive a significantly raised arc starting voltage and frequency, since the arc starting power source 101 is processed by the two raising voltage-raising frequency circuits. When the main power sources 105 supplies power to the arc generator 104 at a frequency of 50 Hz and passes zero point, for the reason that the arc starting source of the high voltage and high frequency is always alive, the arc starting source will supply power to the arc generator 104. That is, with the power supplied by the output of the second raising voltage-raising frequency circuit 103 (i.e. supply power with voltage at tens of thousands volts and currents at tens of thousands Hertz), the arc generator 104 will continue to keep the discharging arc, so as to realize uninterruptedly arc.

In a preferred embodiment of the invention, the first and second raising voltage-raising frequency processes on the arc starting power source A could be realized by one raising voltage-raising frequency circuit.

Figure 7:
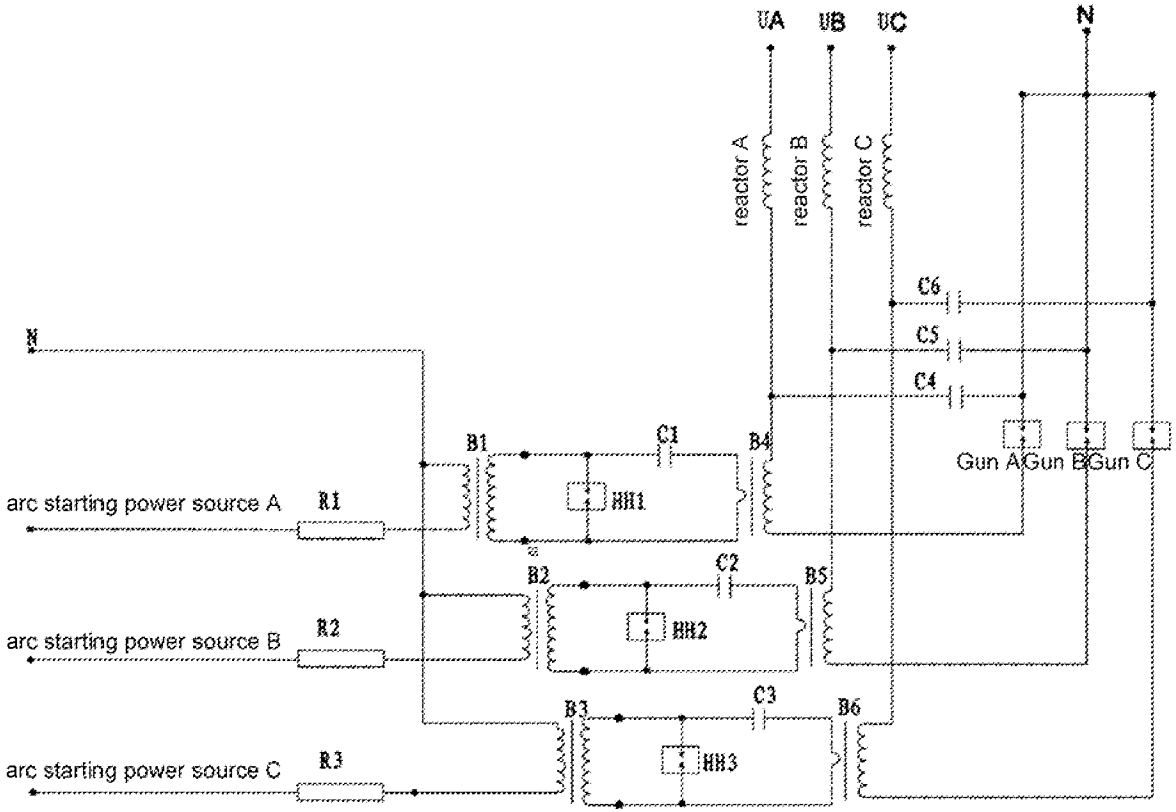
FIG. 7 is a circuit diagram of one embodiment of the circuit for supplying power to the AC plasma ejection gun of the present invention which adopts Y connection.

FIG. 7 is a circuit diagram of one embodiment of the circuit for supplying power to the AC plasma ejection gun of the present invention which adopts Y connection. In this embodiment, both the arc starting power source and the main power source use three-phase AC power source, wherein N denotes ground. Either the main power source or each arc starting power source is one phase of the three-phase power source, and the power of the arc starting power source is much less than that of the main power source. As shown in the figure, the voltage of the arc starting power source A is 220V, the frequency thereof is 50 Hz, while the current intensity is very small, such as less than 2 A, and the arc starting power source A is connected with the primary side of transformer B1 via resistor R1. The voltage of the arc starting power source A is raised (raised to 4 kV) by transformer B1, of which the secondary side is connected with capacitor C1 to form a LC oscillating circuit for raising the frequency of the arc starting power source A, raising the frequency to 4 kHz for example. Wherein, tungsten electrode HH1 is connected with the secondary side of the transformer B1 in parallel to release the electric energy of the oscillating circuit. Then, the current of the arc starting power source A, of which the voltage has been raised by the transformer B1, passes the primary side of transformer B4. After the voltage raising processed by the transformer B4 again, the voltage at the secondary side of the transformer B4 will reach tens of thousands volts (for example 28 KV). The secondary side of transformer B4 is connected with capacitor C4 to form another oscillating circuit to raise the frequency of the arc starting power source A. By now, the frequency of the current outputted by the arc starting power source A will reach tens of thousands of Hertz (for example 30 KHz). An arc generator is connected in the oscillating circuit in series, which is AC plasma ejection gun A (called "gun A" for short in the figure) in this embodiment. The voltage of the main power source UA is 220 V, the frequency thereof is 50 Hz. The main power source is connected with a reactor A in series, the reactor is used for preventing current from striking the circuit in the upstream direction. The main power source UA is connected in series with the secondary side of transformer B4 and AC plasma ejection gun A to provide AC power having voltage of 220V and frequency of 50 Hz for excite arc discharging to produce plasma. The arc starting power source of high voltage and high frequency will uninterruptedly supply power to the AC plasma ejection gun to produce plasma when the main power source UA supplying power to the AC plasma ejection gun is passing the zero point for the AC power's characteristic. The plasma ejection gun will uninterruptedly produce plasma torch even if there is flowing air in the AC plasma gun.

The arc starting power source B is similar as the arc starting power source A, and is connected with transformer B2 to raise its voltage. And the frequency of the arc stating power source B is raised in an oscillating circuit constituted by the secondary side of transformer B2 and capacitor C2. Then after the voltage is raised by transformer B5, the frequency thereof is raised by the oscillating circuit constituted by the secondary side of transform B5 and capacitor C5. Therefore, the arc starting power source B of high voltage and high frequency will uninterruptedly provide AC power for AC plasma ejection gun B ("gun B" for short in the figure) to excite arc discharging and produce plasma torch when the main power source UB providing power to AC plasma ejection gun B is passing zero point and the arc failure appears.

The arc starting power source C is similar as the arc starting power source A, and is connected with transformer B3 to raise its voltage. And the frequency of the arc stating power source C is raised in an oscillating circuit constituted by the secondary side of transformer B3 and capacitor C3. Then after the voltage is raised by transformer B6, the frequency thereof is raised by the oscillating circuit constituted by the secondary side of transform B6 and capacitor C6. Therefore, the arc starting power source C of high voltage and high frequency will uninterruptedly provide AC power for AC plasma ejection gun C ("gun C" for short in the figure) to excite arc discharging and produce plasma torch when the main power source UC providing power to AC plasma ejection gun C is passing zero point and the arc failure appears.

Figure 8:
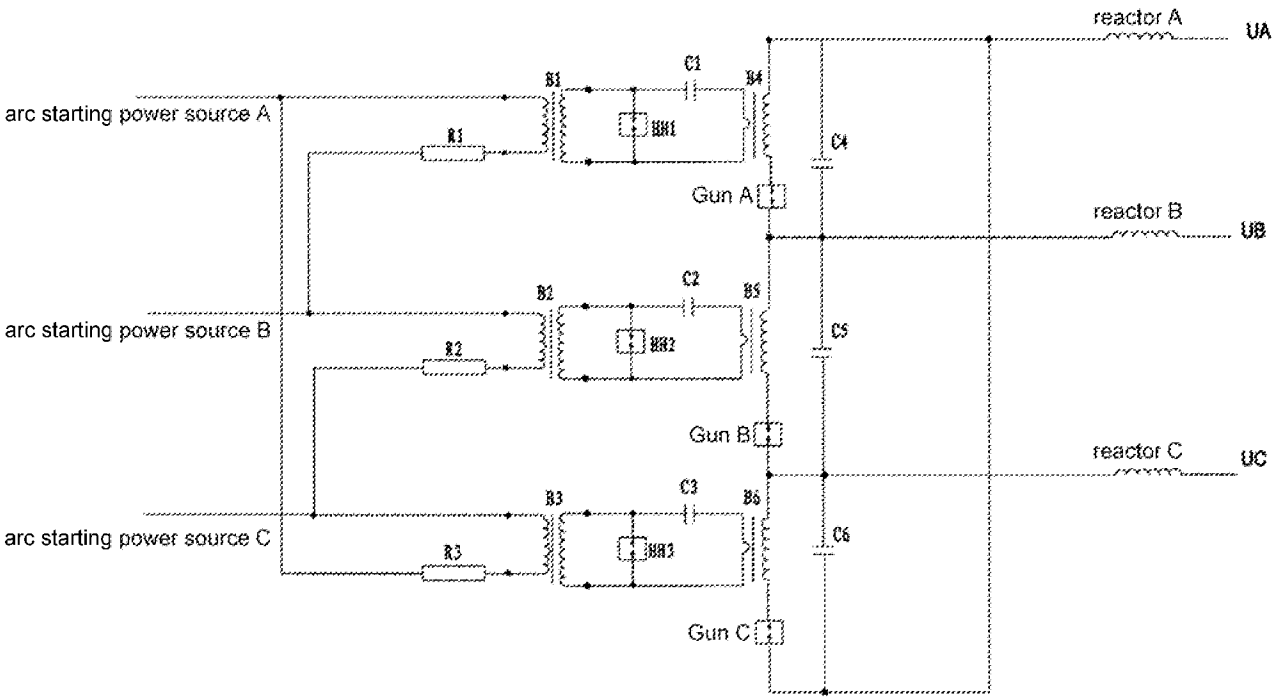
FIG. 8 is a circuit diagram of one embodiment of the circuit for supplying power to the AC plasma ejection gun of the present invention which adopts triangular connection.

FIG. 8 is a circuit diagram of one embodiment of the circuit for supplying power to the AC plasma ejection gun of the present invention which adopts triangular connection. In this embodiment, both the arc starting power source and the main power source use three-phase AC power source. Either the main power source or each arc starting power source is one phase of the three-phase power source, and the power of the arc starting power source is much less than that of the main power source. As shown in the figure, the line voltage of the arc starting power source A is 380V, the frequency thereof is 50 Hz, while the current intensity is very small, such as less than 2 A, and the arc starting power source A is connected with the primary side of transformer B1 via resistor R1. The voltage of the arc starting power source A is raised (raised to 4 kV) by transformer B1, of which the secondary side is connected with capacitor C1 to form a LC oscillating circuit for raising the frequency of the arc starting power source A, raising the frequency to 4 kHz for example. Wherein, tungsten electrode HH1 is connected with the secondary side of the transformer B1 in parallel to release the electric energy of the oscillating circuit. Then, the current of the arc starting power source A, of which the voltage has been raised by the transformer B1, passes the primary side of transformer B4. After the voltage raising processed by the transformer B4 again, the voltage at the secondary side of the transformer B4 will reach tens of thousands volts (for example 28 KV). The secondary side of transformer B4 is connected with capacitor C4 to form another oscillating circuit to raise the frequency of the arc starting power source A. By now, the frequency of the current outputted by the arc starting power source A will reach tens of thousands of Hertz (for example 30 KHz). An arc generator is connected in the oscillating circuit in series, which is AC plasma ejection gun A (called "gun A" for short in the figure) in this embodiment. The line voltage of the main power source UA is of several hundreds Volts (380V for example), the frequency thereof is 50 Hz. The main power source is connected with a reactor A in series, the reactor is used for preventing current from striking the circuit in the upstream direction. The main power source UA is connected in series with the secondary side of transformer B4 and AC plasma ejection gun A to provide AC power having voltage of 380V and frequency of 50 Hz for exciting arc discharging to produce plasma. The arc starting power source of high voltage and high frequency will uninterruptedly supply power to the AC plasma ejection gun to produce plasma when the main power source UA supplying power to the AC plasma ejection gun is passing the zero point for the AC power's characteristic. The plasma ejection gun will uninterruptedly produce plasma torch even if there is flowing air in the AC plasma gun.

The arc starting power source B is similar as the arc starting power source A, and is connected with transformer B2 to raise its voltage. And the frequency of the arc stating power source B is raised in an oscillating circuit constituted by the secondary side of transformer B2 and capacitor C2. Then after the voltage is raised by transformer B5, the frequency thereof is raised by the oscillating circuit constituted by the secondary side of transform B5 and capacitor C5. Therefore, the arc starting power source B of high voltage and high frequency will uninterruptedly provide AC power for AC plasma ejection gun B ("gun B" for short in the figure) to excite arc discharging and produce plasma torch when the main power source UB providing power to AC plasma ejection gun B is passing zero point and the arc failure appears.

The arc starting power source C is similar as the arc starting power source A, and is connected with transformer B3 to raise its voltage. And the frequency of the arc stating power source C is raised in an oscillating circuit constituted by the secondary side of transformer B3 and capacitor C3. Then after the voltage is raised by transformer B6, the frequency thereof is raised by the oscillating circuit constituted by the secondary side of transform B6 and capacitor C6. Therefore, the arc starting power source C of high voltage and high frequency will uninterruptedly provide AC power for AC plasma ejection gun C ("gun C" for short in the figure) to excite arc discharging and produce plasma torch when the main power source UC providing power to AC plasma ejection gun C is passing zero point and the arc failure appears.

Figure 9:
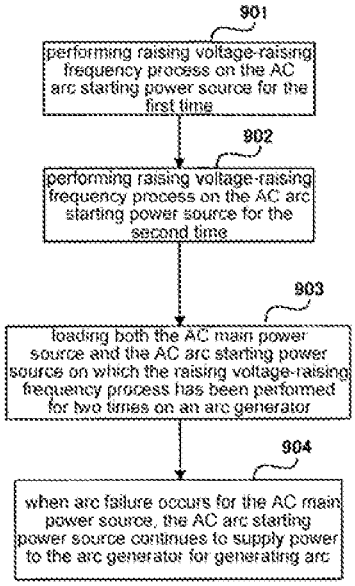
FIG. 9 is a flow process diagram illustrates the method for supplying power to AC plasma ejection gun to generate arc uninterruptedly in the present invention.

FIG. 9 is a flow process diagram illustrates the method for supplying power to AC plasma ejection gun to generate arc uninterruptedly according to the present invention. As shown in step 901, a first voltage raising and frequency raising process is performed on the AC arc starting power source. As shown in step 902, a second voltage raising and frequency raising process is performed on the AC arc starting power source on which the first voltage raising and frequency raising process has been performed. The main power source and the arc starting power source on which the two voltage raising and frequency raising process have been performed are loaded on the arc generator in step 903. For step 904, the arc starting power source on which the two voltage raising and frequency raising process have been performed will continue to supply power to the arc generator to enable the arc generator to produce arc when the main power source is passing the zero point and the arc failure appears.

As an preferred embodiment, the first voltage raising and frequency raising process comprises: raising the output voltage of the AC starting arc power source by a first transformer; and raising the output frequency of the AC arc starting power source by a first oscillating circuit constituted by a secondary side of said first transformer and a first capacitor which are connected with each other in parallel.

The second voltage raising and frequency raising process comprises: raising again, by a second transformer, the output voltage of the AC starting arc power source on which the first voltage raising and frequency raising process has been performed; and raising again, by a second oscillating circuit constituted by a secondary side of said second transformer and a second capacitor which are connected with each other in parallel, the output frequency of the AC arc starting power source on which the first voltage raising and frequency raising process has been performed.

As a preferred embodiment, the first raising voltage-raising frequency circuit further comprises: a tungsten electrode, which is connected with the secondary side of said first transformer in parallel to release the electric energy of the first oscillating circuit.

As a preferred embodiment, the main AC power source is in parallel connection with the second capacitor to provide the arc generator with the main AC voltage to produce arc.

As a preferred embodiment, the AC arc starting power source is in Y connection with an AC power source with, and the main AC power source is in Y connection with the AC power source; or the AC starting arc power source is in triangle connection with the AC power source and the main AC power source is in triangle connection with the AC power source.

As a preferred embodiment, the output voltage and frequency of the AC power source in Y type connection is 220V & 50 Hz, and the output voltage and frequency of main AC power source in Y type connection is 220V & 50 Hz.

The output voltage and frequency of said AC starting arc power source in triangle connection is 380V & 50 Hz, and output voltage and frequency of the main AC power source in Y connection is 380V & 50 Hz.

As a preferred embodiment, the output power of the AC arc starting power source is much less than the output power of the main AC power source.

As a preferred embodiment, the two processes of raising voltage-raising frequency could be simplified as one raising voltage-raising frequency process.

As a preferred embodiment, both the main AC power source and the AC starting arc power source could be three-phase source.

Wherein, there is flowing air between the discharging electrodes of the arc generator. In the embodiment of producing plasma by the arc generator, the air flowing between the electrodes could be ionized sufficiently to form continuous tubular plasma atmosphere for that the arc generator can produce uninterrupted arc.

The advantage of the present invention lies in that the method for supplying power to AC plasma ejection gun to generate arc uninterruptedly and the corresponding device could make the equipment uninterruptedly produce arc to produce a plasma torch without being affected by the phenomenon of AC power source passing zero points, thereby improved the production efficiency.

Embodiment 3

Figure 10:
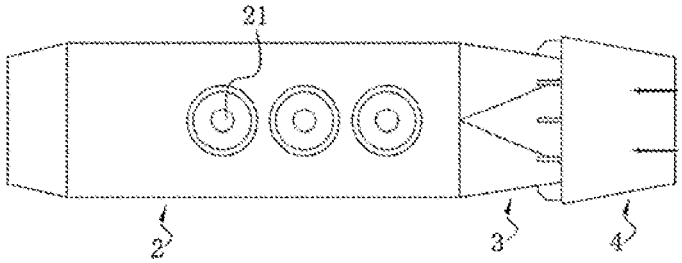
FIG. 10 is a figure illustrates the front view of the multi-stage ignition pulverized coal burner of the present invention.
Figure 11:
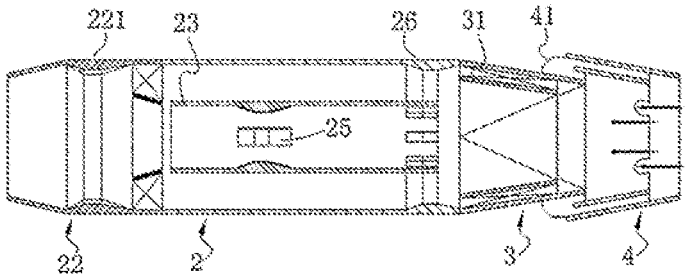
FIG. 11 is a figure illustrates the front sectional view of the multi-stage ignition pulverized coal burner of the present invention.
Figure 12:
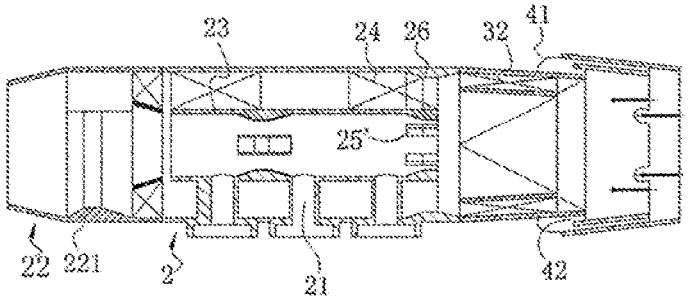
FIG. 12 is a figure illustrates the top sectional view of the multi-stage ignition pulverized coal burner of the present invention.

As shown in FIGS. 10-12, the present invention provides a pulverized coal burner, specifically it is a multi-stage ignition pulverized coal burner, comprising a multi-stage ignition combustion chamber 2, on the side wall of which a plurality of jacks 21 are set, and an ignition device is set in each jack 21, here the ignition device is an AC plasma ejection gun G, for igniting the pulverized coal in the multi-stage ignition combustion chamber 2. In the embodiment, the multi-stage ignition combustion chamber 2 is an ignition combustion chamber of three stage and three jacks 21 are set on its side wall.

In the present invention, the pulverized coal is ignited by the ignition devices in the multi-stage ignition combustion chamber 2 step-by-step, in other words, a plurality of the ignition devices act on the pulverized coal in three stages of initial preheating ignition, stable burning torch, enhanced combustion, so as to keep the pulverized coal under the plasma torch for longer time and increase its area in connection with fire, therefore it overcomes the limitation of the time for heating the pulverized coal being short caused by short plasma fire.

Figures 13, 13A, 14, 14A, 14B, 15, 15A, 15B:
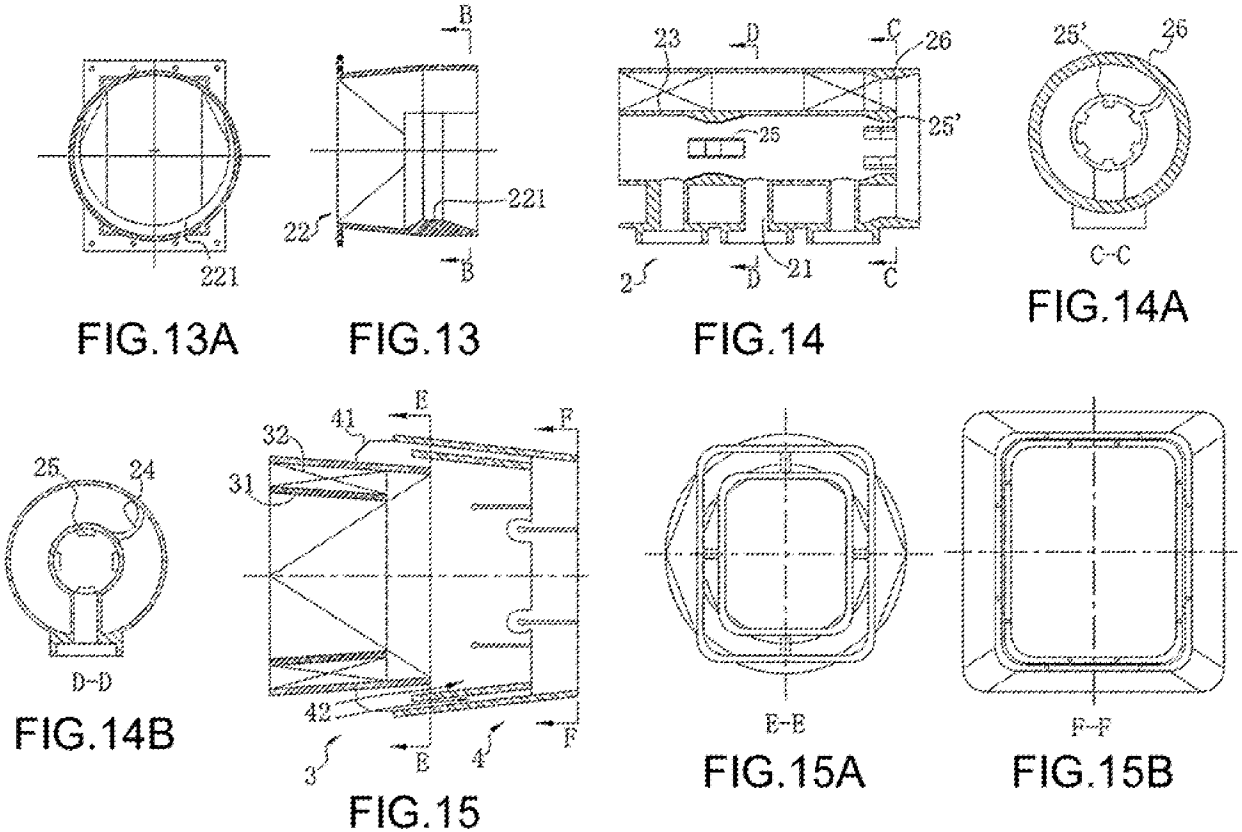
FIG. 13 is a figure illustrates the front sectional view of the pulverized coal inlet portion of the multi-stage ignition pulverized coal burner of the present invention.
FIG. 13A is a figure illustrates the sectional view taken along line B-B of FIG. 13.
FIG. 14 is a figure illustrates the front sectional view of the multi-stage ignition combustion chamber of the present invention.
FIG. 14A is a figure illustrates the sectional view taken along line C-C of FIG. 14.
FIG. 14B is a figure illustrates the sectional view taken along line D-D of FIG. 14.
FIG. 15 is a figure illustrates the sectional view under the circumstance that the mixing combustion chamber is combined with the combustion chamber with extra oxygen supplement according to the present invention.
FIG. 15A is a figure illustrates the sectional view taken along line E-E in FIG. 15.
FIG. 15B is a figure illustrates the sectional view taken along line F-F in FIG. 15.

In a preferred embodiment, as shown in the FIG. 13-13A, an eccentric separation part 221 is set at the side wall of the pulverized coal inlet in connection with the front end of the multi-stage ignition combustion chamber 2, so that the pulverized coal from a bended pipe (not shown in the figure) will be led into the central part of a pipe with the hit from the eccentric separation part 221.

As shown in the FIGS. 14, 14A and 14B, a guiding pipe for concentrated coal powder 23 is axially set at the center of the multi-stage ignition combustion chamber 2, which is connected with the outside wall of the multi-stage ignition combustion chamber 2 with at least one tie strap 24. After the pulverized coal from the bended pipe passed the eccentric separation part 221, it is divided into two flows of concentrated coal powder and light coal powder. The concentrated coal powder enters into a concentrated powder pipe 23 and burns, while the light coal powder enters into a gap between the concentrated powder pipe 23 and the outside wall of the multi-stage ignition combustion chamber 2 and does not attend burning, but is used to cool the concentrated powder pipe 23 so as to prevent overheating and slag deposition. Wherein, because the high temperature of multi-stage ignition combustion chamber 2 will cause the concentrated powder pipe 23 to expand at portrait or landscape direction, the tie strap 24 preferably is curved so that the curved tie strap 24 could eliminate internal stress by deforming itself. A nozzle of the ignition device is set at the inside of the concentrated powder pipe 23 for igniting the concentrated powder in the concentrated powder pipe 23.

In the present invention, accompanying with the mixing of the high temperature plasma ejected from the AC plasma ejection gun and the concentrated coal powder in the concentrated powder pipe 23, the physical and chemical mixing process therebetween will increase the original volatile ingredient by about 80%, decrease the fire point, speed up the fire spreading. Besides, for the character of step-by-step ignition in the multi-stage ignition combustion chamber 2, the density of coal powder and the air flow speed are in a good condition for ignition. Therefore, a stable ignition and fire process could be achieved. In other words, the multi-stage ignition combustion chamber 2 vertically sends the concentrated coal powder into the central part of the ignition torch of the ignition device, so as to greatly improve the original volatile ingredient of the pulverized coal. In addition, the technology of the light coal powder flowing relative to the concentrated strong coal powder avoids the coal powder from flowing close to wall and the slap deposition, and also solved the fire ablation of the burner.

In a preferred embodiment, a disturbing ring is set on at least one place of the inner wall of the concentrated powder pipe 23 in the axial direction. Disturbing rings 25, 25' are set at two places in this embodiment, which are at the middle position and the end of the concentrated powder pipe 23. The Two disturbing rings 25, 25' will strongly disturb the head-on air flow and speed up the transverse flowing speed, therefore plays the function of mixing thoroughly and enhancing the burning in unit length. Wherein, it the preferable that the disturbing ring 25' is vertically and gradually connected with the multi-stage ignition combustion chamber 2, which will have a function of rolling and absorbing the coal powder and can absorb the pulverized coal near the end of the multi-stage ignition combustion chamber 2 into the multi-stage ignition combustion chamber 2 for ignition again.

In a preferred embodiment, an eccentric separation part 26 is set on the side wall at the end of the multi-stage ignition combustion chamber 2, which will draw the light coal powder between the outside wall of the multi-stage ignition combustion chamber 2 and the concentrated power pipe 23 close to the central part.

For the three stage ignition combustion chamber involved in this embodiment, its output could be designed from 500 kg/h to 1200 kg/h according to different character of pulverized coal, and the temperature of the nozzle is not lower than 1200 C.

Embodiment 4

In this embodiment, as shown in FIGS. 14, 14A, 14B, the burner still comprises a mixing combustion chamber 3, except for the multi-stage ignition combustion chamber 2. The mixing combustion chamber 3 is connected with the pulverized coal outlet (end) of the multi-stage ignition combustion chamber 2. A separation pipe 31 is set at the center of the mixing combustion chamber 3 along the axial direction, and connected with the outside wall of the mixing combustion chamber 3 by at least one rib 32, the diameter of the rear end of the separation pipe 31 is greater than the diameter of the guiding pipe for concentrated coal powder 23. The pulverized coal from the guiding pipe for concentrated powder 23 is injected into the separation pipe 31 of the mixing combustion chamber 3, and then is burned in the separation pipe 31. At the same time, a part of the light pulverized coal between the guiding pipe for concentrated powder 23 and the outside wall of the multi-stage ignition combustion chamber 2 also enters into the separation pipe 31, and the rest part flows into the next stage from the gap between the separation pipe 31 and the mixing combustion chamber 3 closely along the wall. By this way, it is not only good for ignition in mixing phase, but also good for cooling the wall surface of the mixing phase. Wherein, said rib 32 also could also be designed to be curved and may have the same function as that of the tie strap 24.

In addition, since the separation pipe 31 is set on the side wall at the pulverized coal outlet of the multi-stage ignition combustion chamber 2, most of the light pulverized coal between the guiding pipe for concentrated coal powder 23 and the outside wall of the multi-stage ignition combustion chamber 2 are injected into the separation pipe 31 and attend the burning, with very small part of pulverized coal flowing into the next stage from the gap at the outside of separation pipe 31 closely along the wall.

The other structure, working principle and effect of the present embodiment are same as embodiment 3, therefore is not explained in detail.

Embodiment 5

As shown in FIGS. 15 and 15A, 15B, the burner could also comprise a combustion chamber with extra oxygen supplement 4, which is connected with the end of the mixing combustion chamber 3 to let all the pulverized coal in the mixing combustion chamber 3 into the combustion chamber with extra oxygen supplement 4. The high temperature flame in the combustion chamber with extra oxygen supplement 4 is mixed with the low concentration coal powder to burn the low concentration coal powder and realize complete burning of the pulverized coal. The volatile ingredients in the first and the second burning chambers 2, 3 almost run out. A measure is used to improve burning ratio of loose carbon by supplying oxygen in advance, which satisfies the need of the oxygen amount for pulverized coal burning, improves the enthalpy of the combustion chamber with extra oxygen supplement 4, and further improves the muzzle velocity of the nozzle to expand the length of fire and improve the burning ratio.

Specifically, the inlet of the combustion chamber with extra oxygen supplement 4 is connected with the outside of the end of the mixing combustion chamber 3 by a connecting board 41, and forms a slot for renewing air therebetween. The oxygen in the pipe basically runs out because of the two-stage burning in the multi-stage ignition combustion chamber 2 and the mixing combustion chamber 3, therefore the wind enters from the slot for air renewing enhances the following combustion of the pulverized coal.

In a preferred embodiment, the slot for renewing air in the combustion chamber with extra oxygen supplement 4 is a double layer slot for air supply 42. There is high temperature fire in the nozzle of the burner, and there is heat radiation from the high temperature fire in the chamber outside of the nozzle of the burner. The renewing air enters into the combustion chamber with extra oxygen supplement 4 from the double layer slot for air supply 42, which can cool the inside and outside wall, and timely supply oxygen to enhance combustion. In other words, the peripheral cooling renewing air technology could timely supply oxygen for combustion, and avoid nozzle being damaged from high temperature fire and slap deposition on the wall. It can meet the requirement of burner starting, burner stopping and stable combustion of burner with low load.

It is proved by experiments that adopting the above structure and principle will let the output of single burner increased from 2 t/h to 12 t/h.

The other structure, the principle and advanced effect of this embodiment are same as embodiment 4, and do not say more explanation.

Embodiment 6

Figure 16:
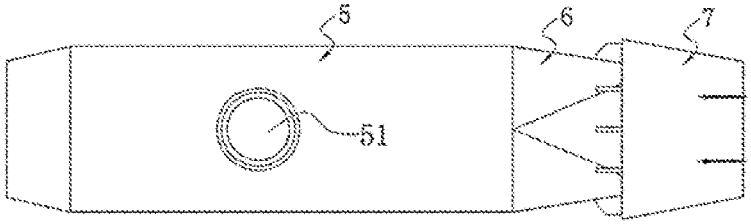
FIG. 16 is a figure illustrates the front view of the speed-lowering pulverized coal ignition chamber according to the present invention.
Figure 17:
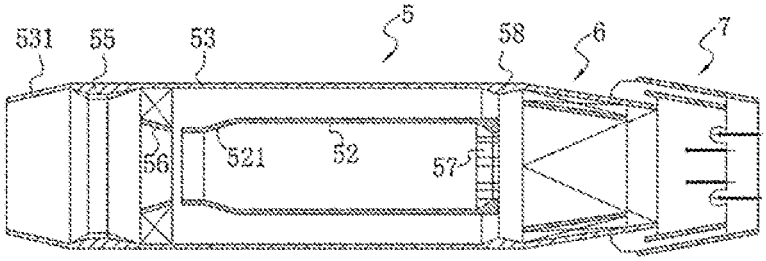
FIG. 17 is a figure illustrates the front sectional view of the speed-lowering pulverized coal ignition chamber according to the present invention.
Figure 18:
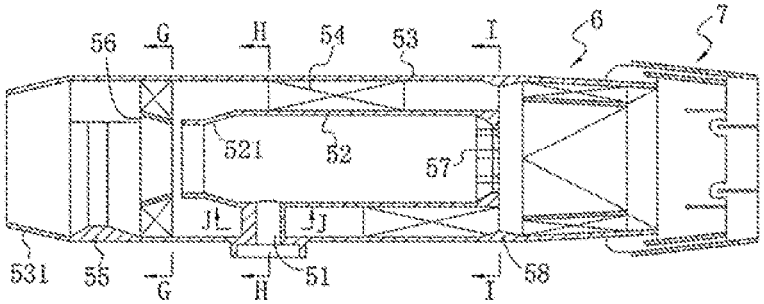
FIG. 18 is a figure illustrates the top sectional view of the speed-lowering pulverized coal ignition chamber according to the present invention.
Figure 18A:
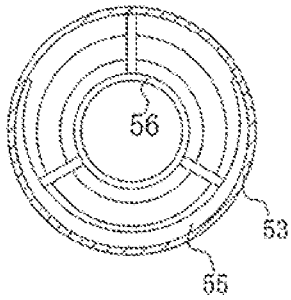
FIG. 18A is a figure illustrates the sectional view taken along line G-G of FIG. 18.
Figure 18D:
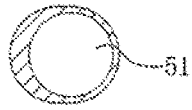
FIG. 18D is a figure illustrates the sectional view taken along line J-J of FIG. 18.
Figure 18B:
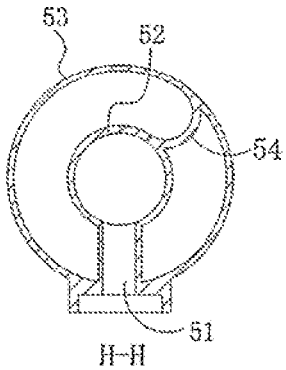
FIG. 18B is a figure illustrates the sectional view taken along line H-H of FIG. 18.
Figure 18C:
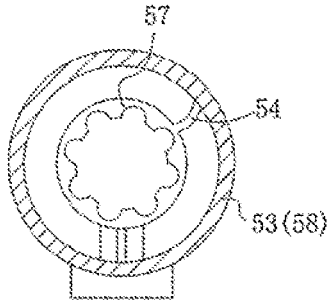
FIG. 18C is a figure illustrates the sectional view taken along line I-I of FIG. 18.

As shown in FIG. 16-18, the present invention provides a pulverized coal burner, specifically is a speed-lowering ignition burner. The speed-lowering ignition burner comprises a speed-lowering ignition combustion chamber 5, and at least one jacks 51 are set at the side wall of the speed-lowering ignition combustion chamber 5 in the axial direction. There is one jack 51 in this embodiment. An AC plasma ejection gun G is set at the inside of the jack 51 to ignite the pulverized coal in the speed-lowering ignition combustion chamber 5. Of course, the AC plasma ejection gun G could be substituted by a tiny oil gun or a DC plasma ejection gun.

With the other conditions unchanged, the heating energy of pulverized coal is in direct proportion to the heating time. Each time the air flow speed is lowered, the heating energy of pulverized coal by fire would be doubled. The ignition combustion chamber is a speed-lowering ignition combustion chamber 5 in the present invention. It could decrease the pulverized coal speed passing through the speed-lowering ignition combustion chamber, so as to prolong the time for the pulverized coal staying in high temperature fire, and thus improve heating energy of pulverized coal by fire, to speed up heating chemical transition for re-creating volatile ingredient and promote complete combustion, and further to facilitate ignition and stable fire.

In the detailed embodiment, the speed-lowering ignition combustion chamber comprises a speed-lowering pipe 52, the cross section of the speed-lowering pipe 52 at the front portion 521 of the speed-lowering pipe 52 in the direction from the pulverized coal inlet to the pulverized coal outlet enlarges gradually, the nozzle of said plasma ejection gun G is set at the inside of the speed-lowering pipe 52 and is at the enlarged place of the cross section. In other words, for the generally enlarging design of the front of the speed-lowering pipe 52, the speed of the pulverized coal passing through this place will be lowered gradually and this is good for the ignition of pulverized coal.

As shown in FIG. 18A-FIG. 18D, the speed-lowering ignition combustion chamber further comprises a pipe wall 53, the speed-lowering pipe 52 is set at the central position of pipe wall 53 in the axial direction. The speed-lowering pipe 52 is connected with the pipe wall 53 by at least one tie strap 54. Wherein, because the high temperature flame of the speed-lowering ignition combustion chamber will cause the speed-lowering pipe 52 to expand at portrait or landscape direction, the tie strap 54 preferably is curved so that the curved tie strap 54 could eliminate internal stress by deforming itself.

In a preferred embodiment, the front end of the pipe wall 53 sticks out of the front end of the speed-lowering pipe 52 in the axial direction. A gradually enlarging part 531 is set at the front (i.e. the front end sticking out of the speed-lowering pipe 52) of the pipe wall 53. The cross-section of the gradually enlarging part 531 enlarges from the inlet to outlet of pulverized coal gradually.

At a position on the inside surface of the pipe wall 53 and between the gradually enlarging part 531 and the speed-lowering pipe 52 along the axial direction, an eccentric separation part 55 is set for guiding the pulverized coal from a bended pipe pipe (not shown in the figure) to the central area of the pipe wall 53 by hitting of the eccentric separation part 55. Preferably, a guiding pipe for concentrated pulverized coal 56 is set at a position between the eccentric separation part 55 and speed-lowering pipe 52 and at the central of the pipe wall 53 along the axial direction, for guiding pulverized coal from the eccentric separation part 55 into the speed-lowering pipe 52.

An eccentric separation part 55 is set at the inside surface of pipe wall 53 and also at axial position between gradually enlarging part 531 and speed-lowering pipe 52 to guide the pulverized coal from bended pipe (not shown in the figure) to central area of pipe wall 53 by hitting of the eccentric separation part 55, and the preferred hitting area should be the position between the eccentric separation part 55 and speed-lowering pipe. A guiding pipe for concentrated coal powder 56 is set at the central axis of pipe wall 53 to guide pulverized coal from the eccentric separation part 55 into speed-lowering pipe 52.

The speed of the pulverized coal from the bended pipe is lowered in the gradually enlarging part 531 for a first time, and then the pulverized coal is guided to the central area of the pipe wall 53 by the hitting of the eccentric separation part 55. Then, the guiding pipe for concentrated coal powder 56 will divide the pulverized coal into two flows of a dense coal flow and a light coal flow. The dense coal flow is injected into the speed-lowering pipe 52 and burns, and the speed thereof is then lowered secondly at the front end of the speed-lowering pipe 52. The speed of the dense coal flow having been lowered for the second time could be design to be 10%-80% of the coal speed after being lowered for the first time. On the other side, the time for which the pulverized coal stays in the high temperature flame is prolonged for 1-5 times, so that the heating energy of fire on pulverized coal will be improved for 1-5 times, and further promotes combustion and is good for ignition. The light coal is injected into the gap between the speed-lowering pipe 52 and the pipe wall 53, but does not burn, which could cool the speed-lowering pipe 52 and prevent overheat and slag deposition of the pipe wall of the speed-lowering pipe 52.

In addition, a disturbing ring 57 is set at the inside wall of the rear end of speed-lowering pipe 52, the severe flame is broken by the disturbing ring to form pulsed ring around high temperature torch. It is good for mixing of peripheral pulverized coal in time, and thus enhances combustion in next stage.

In a preferred embodiment, an eccentric separation part 58 is set at the side wall of the rear end of the speed-lowering ignition combustion chamber 5. The pulverized coal in the speed-lowering ignition combustion chamber 5 is drawn close to the central area by the eccentric separation part 58.

For the speed-lowering ignition combustion chamber in this embodiment, the output could be designed from 500-2000 kg/h according to different pulverized coal characteristics, and its nozzle temperature is not lower than 1200 C.

In addition, a mixing combustion chamber 6 and/or a combustion chamber with extra oxygen supplement 7 could be provided in connection with the end of the speed-lowering ignition combustion chamber 5. Wherein, the detailed structure and working principle of the mixing combustion chamber 6 and the combustion chamber with extra oxygen supplement 7 are same as embodiment 4 and embodiment 5, therefore no detailed explanation is needed.

The above structure and principle of speed-lowering pulverized coal ignition burner will let the output of single burner reach 12 t/h or more, which has been approved by the experiment.

The above embodiments just make detailed explanation for the objects and technology and advanced effect of the present invention. What contained in the above just are specific embodiments and are not intended to limit the protected range of the present invention. Any modification, substitution and improvement should be in the protection range of the present invention.

What is claimed is:

1. An AC plasma ejection gun, comprising:

a power supply device, having a live wire and a null wire, to supply power to the AC plasma ejection gun to generate arc uninterruptedly, the power supply device comprising:

an AC main power source to supply power to the AC plasma ejection gun to produce the arc;

an AC arc starting power source, an output of the AC arc starting power source on which a voltage-raising frequency process has been performed to be uninterruptedly loaded on the AC plasma ejection gun, and, when the AC main power source is passing a zero point, the AC arc starting power source on which the voltage-raising frequency process has been performed to continue to supply power to the AC plasma ejection gun to produce the arc;

a first voltage-raising frequency circuit comprising:

a first transformer to raise an output voltage of the AC arc starting power source to a first voltage;

a first oscillating circuit comprising a secondary side of the first transformer and a first capacitor connected in parallel to raise an output frequency of the AC arc starting power source to a first frequency; and a tungsten electrode connected in parallel with the secondary side of the first transformer to release electric energy of the first oscillating circuit and to raise the output frequency of the AC arc starting power source; and a second voltage-raising frequency circuit comprising:

a second transformer to raise the output voltage of the AC arc starting power source from the first voltage to a second voltage; and a second oscillating circuit comprising a secondary side of the second transformer and a second capacitor connected in parallel to raise the output frequency of the AC arc starting power source from the first frequency to a second frequency;

an electric front electrode defining a front chamber, a nozzle connected with the front chamber at an outlet of the front electrode, an air inlet pipe connected with the front chamber at an inlet of the front electrode, the front electrode connected with the null wire; and an electric rear electrode, connected with the inlet of the front electrode by an insulated ring, a gap between the electric rear electrode and the front electrode, the rear electrode being connected with the live wire, a spinning air inlet ring at an outside of the gap between the electric front electrode and the rear electrode, compressed air from the air inlet pipe to pass the spinning air inlet ring and to enter into the front chamber; wherein, an arc between the front electrode and the rear electrode is to discharge, ionizing the compressed air into plasma in the gap between the front electrode and the rear electrode, and the plasma is to be ejected out of the nozzle from the front chamber.

2. The AC plasma ejection gun according to claim 1, wherein the spinning air inlet ring is circular, a plurality of air inlet jacks are located on a circumferential wall of the spinning air inlet ring along a tangent direction, and each of the jacks is connected with a corresponding air inlet pipe.

3. The AC plasma ejection gun according to claim 2, wherein the rear electrode has a rear chamber, a rear end of the rear chamber is closed and a front end of the rear chamber is open, and the rear end of the rear electrode is connected with a terminal, and a through hole connected with compressed air is at the terminal in an axial direction.

4. The AC plasma ejection gun according to claim 2, wherein the ejection gun further comprises a front sleeve around an outside of the front electrode;

a front water cooling system is outside of the front electrode, the front water cooling system comprises a water inlet pipe, a water outlet pipe and a fluid channel between the front electrode and the front sleeve, and the fluid channel is connected with the water inlet pipe and the water outlet pipe.

5. The AC plasma ejection gun according to claim 4, wherein the front water cooling system comprises a half-sleeve in the front sleeve, the half-sleeve covers the outside of the front electrode, there is a gap between the half-sleeve and the front electrode, a plurality of projections are around an outside of the half sleeve in a circumferential direction, the water inlet pipe and the outlet pipe are interlaced in an axial direction, and a first one of the projections is at a position between the water inlet pipe and the water outlet pipe in the axial direction.

6. The AC plasma ejection gun according to claim 5, wherein the ejection gun further comprises a rear sleeve around an outside of the rear electrode, a rear water cooling system is set at an outside of the rear electrode, the rear water cooling system comprises a second water inlet pipe, a second water outlet pipe and a second fluid channel between the rear electrode and the rear sleeve, and the second fluid channel is connected with the second water inlet pipe and the second water outlet pipe.

7. The AC plasma ejection gun according to claim 6, wherein the rear sleeve comprises a first rear sleeve and a second rear sleeve which are hermetically connected, the second water inlet pipe and second water outlet pipe are at the first rear sleeve, a first end of the second rear sleeve is hermetically connected with the first rear sleeve, and a second end of the second rear sleeve is hermetically connected with the projection of the rear electrode.

8. The AC plasma ejection gun according to claim 1, wherein the AC main power source and the second capacitor are connected in parallel, to provide the AC plasma ejection gun with main AC voltage to produce the arc.

9. The AC plasma ejection gun according to claim 1, wherein the AC arc starting power source is in a Y connection and the AC main power source is in a Y connection; or the AC arc starting power source is in a triangle connection and the AC main power source is in a triangle connection.

10. The AC plasma ejection gun according to claim 9, wherein the output voltage of the AC arc starting power source in the Y connection is 220V, the frequency of the AC arc starting power source is 50 Hz, an output voltage of the main AC power source in the Y connection is 220V, a frequency of the main AC power source is 50 Hz; and the output voltage of the AC arc starting power source in the triangle connection is 380V, the frequency of the AC arc starting power source is 50 Hz, the output voltage of the main AC power source in the triangle connection is 380V, the frequency of the AC arc starting power source is 50 Hz.

11. The AC plasma ejection gun according to claim 1, wherein an output power of the AC arc starting power source is less than an output power of the AC main power source, and flowing air is between the discharging electrodes of the AC plasma ejection gun.

12. A pulverized coal burner, comprising a multi-stage ignition combustion chamber, a plurality of jacks are in a side wall of the multi-stage ignition combustion chamber along an axial direction, an AC plasma ejection gun according to claim 1 is inside of each jack to ignite pulverized coal passed through the multi-stage ignition combustion chamber.

13. The pulverized coal burner according to claim 12, wherein the burner further comprises a mixing combustion chamber connected with a rear end of the multi-stage ignition combustion chamber; and a separation pipe at a center of the mixing combustion chamber in the axial direction, a diameter of the rear end of the separation pipe is larger than a diameter of the guiding pipe for concentrated coal powder, the separation pipe being connected with an outside wall of the mixing combustion chamber by at least one curved rib board.

14. The pulverized coal burner according to claim 13, wherein the burner further comprises a combustion chamber with extra oxygen supplement, the combustion chamber being connected with an end of the mixing combustion chamber, an inlet of the combustion chamber is at an outside of the end of the mixing combustion chamber by a connecting board, and a double layer slot to renew air is between the combustion chamber and the mixing combustion chamber.

15. A pulverized coal burner having a speed-lowering ignition combustion chamber, at least one jack in a side wall of the speed-lowering ignition combustion chamber along an axial direction, and an AC plasma ejection gun according to claim 1 inside of each jack, to ignite pulverized coal in the speed-lowering ignition combustion chamber.

16. The pulverized coal burner according to claim 15, wherein;

the speed-lowering ignition combustion chamber comprises a pipe wall and speed-lowering pipe, which is in a front of the speed-lowering ignition combustion chamber, a cross section of the speed-lowering pipe from a pulverized coal inlet to an outlet is gradually enlarging, a nozzle of the AC plasma ejection gun is provided inside of the speed-lowering pipe and at a position where the cross section is enlarged, a front end of the pipe wall sticks out a front end of the speed-lowering pipe, and a gradually enlarging part is provided at the front end of the pipe wall, a cross section of the gradually enlarging part gradually enlarging along a direction from a pulverized coal inlet end to a pulverized coal outlet end.

17. The pulverized coal burner according to claim 16, wherein the speed-lowering pipe is at a central position of the pipe wall in an axial direction, and the speed-lowering pipe is connected with the pipe wall by at least one curved tie strap; the tie strap being configured to be curved.

18. The pulverized coal burner according to claim 17, further comprising a disturbing ring at an inside wall of a rear end of the speed-lowering pipe, and a separation part at the inside wall of the rear end of the pipe wall of the speed-lowering ignition combustion chamber.

19. The pulverized coal burner according to claim 15, wherein the burner further comprises a mixing combustion chamber connected with a rear end of the speed-lowering ignition combustion chamber, a separation pipe is at a center of the mixing combustion chamber along an axial direction, a first diameter of a rear end of the separation pipe is larger than a second diameter of the speed-lowering pipe, and the separation pipe is connected with an outside wall of the mixing combustion chamber by at least one curved rib.

20. The pulverized coal burner according to claim 19, wherein the burner further comprises a combustion chamber with extra oxygen supplement, the combustion chamber being connected with a rear end of the mixing combustion chamber, an inlet of the combustion chamber is connected with an outside of the rear end of the mixing combustion chamber by a connecting board, and a double layer slot to renew air is between the inlet of the combustion chamber and the mixing combustion chamber.

* * * * *